United States Patent [19]

Zwier et al.

[11] Patent Number: 4,736,135

[45] Date of Patent: Apr. 5, 1988

[54] ELECTRON EMISSION DEVICE PROVIDED WITH A RESERVOIR CONTAINING MATERIAL REDUCING THE ELECTRON WORK FUNCTION

[75] Inventors: Jan Zwier, Eindhoven; Johannes H. A. Vasterink, Almelo; Johannes Van Esdonk, Eindhoven, all of Netherlands

[73] Assignee: U.S. Philips Corporation, New York, N.Y.

[21] Appl. No.: 875,801

[22] Filed: Jun. 18, 1986

[30] Foreign Application Priority Data

Jun. 24, 1985 [NL] Netherlands ..... 8501806

[51] Int. Cl.[4] ..... H01J 1/13; H01J 5/02

[52] U.S. Cl. ..... 313/546; 313/346 R

[58] Field of Search ..... 313/546, 346 R, 346 DC

[56] References Cited

U.S. PATENT DOCUMENTS 3,913,999 10/1975 Clarke ..... 313/546 X

FOREIGN PATENT DOCUMENTS 817600 8/1959 United Kingdom ..... 313/546

*Primary Examiner*—David K. Moore
*Assistant Examiner*—K. Wieder
*Attorney, Agent, or Firm*—Robert J. Kraus

[57] ABSTRACT

In order to improve the stability of a cold cathode (5) of the reverse biased junction type, a vacuum space (2) is coupled with a reservoir (10), within which a source (21) of material reducing the work function, for example caesium, is present. By influencing the vapor pressure and the temperature in component parts (13, 16) of the reservoir (10) and in the source (21), loss of caesium due to adsorption or other phenomena occurring at the emitting surface (8) of the cathode (5) can be compensated for by an incident flow of caesium (25).

8 Claims, 1 Drawing Sheet

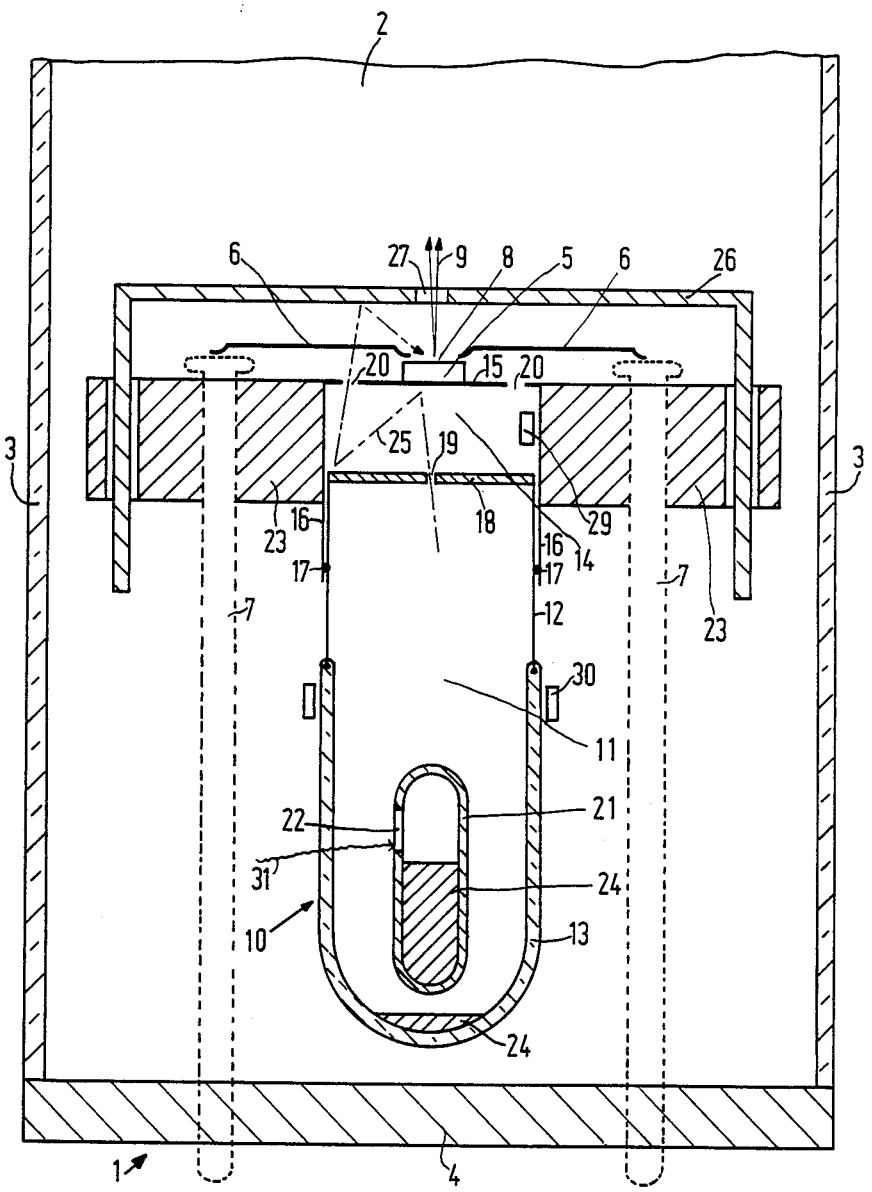
2
6
27
9
8
5
6
26
20
15
20
3
25
19
3
23
16
18
29
16
14
17
17
7
7
12
23
30
11
22
21
31
24
10
13
24
1
4

ELECTRON EMISSION DEVICE PROVIDED WITH A RESERVOIR CONTAINING MATERIAL REDUCING THE ELECTRON WORK FUNCTION

BACKGROUND OF THE INVENTION

The invention relates to a device comprising a space which is evacuated or filled with a protective gas, this device having an electron-emitting body which can be coated at an electron-emitting surface from a reservoir with material for reducing the electron work function.

The electron-emitting body may be a thermionic cathode, for example, in a vacuum tube, but may especially be a semiconductor cathode; in the latter case, various kinds of semiconductor cathodes may be used, such as NEA cathodes, field emitters and more particularly reverse junction cathodes, as described in Netherlands Patent Application No. 7905470, in the name of the Applicant, corresponding to U.S. Pat. Nos. 4,303,930 and 4,370,797. Such vacuum tubes are suitable to be used as camera tubes or display tubes, but may also be used in apparatus for Auger spectroscopy, electron microscopy and electron lithography.

The above devices may also be provided with a photocathode, incident radiation leading to an electron current which leaves the photocathode. Such photocathodes are used in photocells, camera tubes, image converters and photomultiplier tubes. Another application of a device according to the invention resides in so-called thermionic converters, in which thermal radiation is converted into an electron current.

The invention further relates to a reservoir for such an arrangement.

Such a device is known from Netherlands Patent Specification No. 18,162, corresponding to U.S. Pat. No. 1,767,437. In this case, caesium is deposited in a discharge tube by heating a dissolved mixture of caesium chloride and barium oxide so that the caesium chloride is reduced by the released barium to metallic caesium, which spreads over the interior of the discharge tube. In an embodiment shown in the Patent Specification, the mixture to be heated is provided in a side tubule attached to the vacuum tube, which afterwards is sealed off from this tube.

In this arrangement, a quantity of caesium is consequently introduced only once into the vacuum space. If use is made of a semiconductor cathode, this caesium will cover the emitting surface as a mono-atomic layer, after which reduction of the quantity of caesium on the emitting surface cannot or can substantially not be compensated. Such a reduction of caesium or another material reducing the electron work function at the surface is due inter alia to desorption and migration under the influence of electric fields and gives rise to degradation of the emission. The ultimate efficiency of, for example, a reverse biased junction cathode thus remains limited to 20 to 40% of the optimum value.

SUMMARY OF THE INVENTION

It is an object of the invention to provide a device in which the aforementioned problems are eliminated at least in part.

The invention is based on the recognition of the fact that this can be achieved when a source of work function-reducing material is coupled to the vacuum space, while the supply of work-function-reducing material from this source to the emitting surface can be regulated so that the loss of work-function-reducing material at this surface is compensated for.

A device according to the invention is for this purpose characterized in that the reservoir is situated within the space and comprises a source of work-function-reducing material and is provided with at least one exit opening, through which the work-function reducing material can leave the reservoir.

A preferred embodiment of a device according to the invention is characterized in that the reservoir comprises two compartments, which communicate with each other through at least one opening in an intermediate wall, one compartment accommodating the source of material for reducing the electron work function and the other compartment being provided with the exit opening.

In such a device, the supply of electron work function-reducing material from the reservoir can be regulated in a simple manner, for example, in the case of caesium by regulating the rate of evaporation by means of heating and cooling means or by mechanically adjusting the opening in the intermediate wall.

By choosing a suitable dimension of the exit opening(s), it can moreover be achieved that only a small quantity of the evaporated material (for example caesium) reaches the vacuum space, which quantity is sufficient, however, to attain the desired effect (compensation of the loss of caesium due to description and migration). This has the advantage that the actual vacuum space and the deflection electrodes (and other component parts) present therein, are not or substantially not contaminated by the caesium (or another material for reducing the work function), which has a favourable influence on the high-voltage properties of the vacuum tube and the components present therein.

The last-mentioned effect can be further increased when the first acceleration grid is constructed so that the space in which the cathode is situated communicates with the primary vacuum space only via a single opening which at serves to pass the generated electrons. An additional advantage is that the caesium, which now remains practically completely enclosed in the space in which the cathode is situated, exerts a gettering effect in this space, which guarantees a better vacuum and hence an increased stability especially of semiconductor cathodes arranged in this vacuum.

For the source of material reducing the electron work function, a carrier or holder provided with caesium azide may be chosen of the kind described in Netherlands Patent Application No. 8401866 (corresponding to U.S. application Ser. No. 743,221, filed June 10, 1985, and U.S. application Ser. No. 052,294 filed May 21, 1987).

Preferably, however, a glass or metal reservoir is chosen for this purpose, which is filled with caesium and in which an opening can be provided, for example by means of a laser beam.

BRIEF DESCRIPTION OF THE DRAWINGS

The invention will now by way of example be described more fully with reference to an embodiment and the drawing, which shows diagrammatically a part of an arrangement according to the invention.

DESCRIPTION OF THE PREFERRED EMBODIMENT

The device 1 shown in the Figure comprises a vacuum space 2, in this example a vacuum tube with side walls 3 and an end wall 4. The device further comprises an electron-emitting body 5, in this embodiment a semiconductor cathode of the reverse biased junction type, as described in Netherlands Patent Application No. 7905470.

For the application of voltage, the semiconductor cathode 5 is provided with connection wires 6, which are electrically connected by lead-through members 7 in the end wall 4 to such voltages that at the area of the surface 8 an electron current 9 is produced. In order to facilitate the emanation of the electrons produced in this case by avalanche multiplication, the surface 8 is preferably coated with a monoatomic layer of caesium.

During operation, however, this caesium layer can be partly lost, for example due to the etching effect of positive ions left in the vacuum tube or formed during operation. In thermionic cathodes, such a layer of material for reducing the work function can be gradually lost by evaporation.

In order to compensate for this loss of caesium during operation, but also in order to provide, as the case may be, an initial layer of caesium, the arrangement 1 further comprises, according to the invention a reservoir 10 which is composed in this embodiment of a first compartment 11 (whose wall consists in this embodiment partly of a metal wall 12 and partly of a glass wall 13) and of a second compartment 14.

The second compartment 14 has an end wall 15, which in this embodiment substantially coincides with a carrier 23 on the side of the vacuum space 2, while the side walls 16 of the second compartment 14 are connected via a weld 17 to the metal walls 12 of the first compartment 11. The compartments 11, 14 are separated from each other by an intermediate wall, which is provided with an opening 19, while the second compartment 14 communicates with the vacuum space 2 via one or more openings 20.

For the supply of caesium (or another material reducing the work function), the first compartment 11 accommodates, for example, a holder 21 consisting of glass or, as in the present embodiment, of a metal tube. Preferably, a nickel holder 21 is chosen for this purpose, which is filled with pure caesium 24.

The holder 21 can be opened from the outside, for example by means of a laser beam 31 of such a wavelength that the nickel or, as the case may be, a glass wall of the holder 21 melts, but the glass wall 13, which for this purpose is made of another kind of glass, remains unattacked. After the holder 21 has thus been provided with an opening 22, the caesium 24 has the opportunity to escape from the holder 21 in the vapour phase; this may further be promoted by the heat released upon melting of the glass window 22 or by means of heating elements (not shown).

Of the released caesium vapour, for example a part precipitates as liquid caesium 24 in the lower part of the first compartment 11. However, another part leaves this first compartment 11 via one or more openings 19 in the intermediate wall 18 between the first compartment 11 and the second compartment 14, which together constitute the reservoir 10. The caesium in the vapour phase, which moves, for example, along paths 25 shown diagrammatically, leaves in part the second compartment 14 via one or more openings 20 in the end wall 15 and thus reaches the vacuum space 2. The rate of evaporation of caesium deposited in the first compartment 11 and the speed of the caesium atoms (path 25) may be regulated, if required, by internally or externally provided temperature regulators 29 and 30. If desired, the flow of caesium through the walls 15 and 18 may also be made adjustable by making the size of the openings 20 and 19, respectively, variable.

By means of the temperature regulators 29, 30, which may consist, for example, of a combination of a strip resistor and a Peltier cooling element and, as the case may be, a heating diode, which may form part, if required, of the semiconductor cathode 5, it can be achieved that a stable non-critical equilibrium is obtained between the supplied caesium atoms 25 and the caesium atoms drained due to desorption or other phenomena. It has been found that in this manner the stability of the emission can be considerably increased, especially if the emitting body is arranged in a substantially closed space. Thus, a local caesium vapour pressure is obtained in this space, as a result of which a continuous dispensation of caesium atoms on the emitting surface is realized which leads to a high stability.

The substantially closed space is obtained in the present embodiment by means of an extraction grid 26 of practically cylindrical shape having an opening 27 allowing the generated electron beam 9 to pass. Moreover, this construction affords the advantage that the primary vacuum space 2 is not or substantially not contaminated with caesium, which has a favourable influence on the high-voltage properties of the vacuum tube and the elements present therein, such as deflection electrodes.

A continuous dispensation of caesium is possible in the arrangement 1, for example, by regulating the wall temperature of the walls of the reservoirs 11, 14 by means of the temperature regulators 29, 30.

The wall 15 of the second compartment 14 is preferably coated on the inner side with a gold layer. Caesium deposited on this wall forms with the gold caesium azide, which prevents caesium transport in the gap between the grid 26 and the wall 15 due to its low vapour pressure. The gold consequently has, as it were, a gettering effect. This may also be achieved, for example, with antimony. The gold layer may also be advantageously deposited on the inner wall of the extraction grid 26. It is also possible to apply a silver layer. This has the advantage that, after the vacuum device has been baked out, a surface practically free from oxide remains, as a result of which contamination of caesium is strongly reduced.

For the holder 21, alternatively a carrier with, for example, caesium azide ($CsN_3$) may be chosen, which dissociates during the thermal treatment, as described in Netherlands Patent Application No. 8401866 in the name of the Applicant. Preferably, however, pure caesium is chosen because no residual gases are then released. During operation of the arrangement described, no premature supply of caesium occurs either. For the reverse biased junction cathode, this results in a better reproducibility and a high initial efficiency.

Besides, the presence of pure caesium 24, 25 in the compartments 11, 14 and in the space within the grid 26 has a gettering effect. Thus, the vacuum is increased, as a result of which also the stability of the cathode 5 is further increased.

The invention is of course not limited to the embodiment shown here, but many variations are possible for those skilled in the art without departing from the scope of the invention.

For example, the electron-emitting body 5 need not necessarily be arranged on the wall 15, but may also be situated elsewhere in the vacuum space 2 or may be arranged at an oblique angle. When the cathode 5 is secured not on the end wall 15, but elsewhere on the carrier 23, the thermal coupling between the cathode and the reservoir 10 becomes smaller, which may be favourable in connection with the regulation of the supply of caesium. The exit openings 20 may then be provided, for example, in a side wall of the reservoir, which then projects further into the vacuum space. Other cathodes are also possible, such as, for example, field emitters, NEA cathodes or even therm ionic cathodes, while the cathodes made of semiconductor material (silicon, gallium arsenide) may also form part of a larger semiconductor body, in which, for example, also electronic control circuitry is realized.

For the material reducing the electron work function, various other materials may also be chosen, such as potassium, rubidium, sodium or lithium, which is realised, for example, upon heating of a mixture or a compound in the holder/carrier 21.

The reservoir 10 may be made in one piece instead of in the form of two separate compartments, in which event the weld 17 is omitted.

The holder 21 need not necessarily be opened by means of a laser beam; this may be effected, if desired, by high-frequency energy, for example by means of a spring construction as described in U.S. Pat. No. 2,288,253.

What is claimed is:

1. An electron discharge tube comprising a sealed envelope containing a cathode having an electron-emitting surface coated with a work-function-reducing material, said envelope further containing means for providing to said electron-emitting surface a regulated supply of the work-function-reducing material to compensate for a loss of said material during operation of the tube, said means including:

(a) a reservoir having an exit opening with predetermined dimensions in communication with a predefined space in which the cathode is located; and (b) a source contained in the reservoir for supplying the material to the reservoir at a rate sufficient to establish therein a predetermined vapor pressure;

said predetermined vapor pressure and said predetermined dimensions collectively establishing a predetermined rate of flow of said material to the electron-emitting surface.

2. An electron discharge tube comprising a sealed envelope containing a cathode having an electron-emitting surface coated with a work-function-reducing material, said envelope further containing means for providing to said electron-emitting surface a regulated supply of the work-function-reducing material to compensate for a loss of said material during operation of the tube, said means including a reservoir comprising first and second compartments communicating through a passageway with predetermined dimensions, said first compartment containing a source for supplying the material to the reservoir at a rate sufficient to establish a predetermined vapor pressure, and said second compartment having an exit opening with predetermined dimensions communicating with a predefined space in which the cathode is located, said predetermined vapor pressure and said predetermined dimensions collectively establishing a predetermined rate of flow of said material to the electron-emitting surface.

3. An electron discharge tube as in claim 1 or 2 where the cathode is secured to an outer surface of the reservoir in a location adjacent to the exit opening.

4. An electron discharge tube as in claim 1 or 2 including means for regulating the temperature in the reservoir, thereby regulating said vapor pressure.

5. An electron discharge tube as in claim 1 or 2 where the space in which the cathode is located is contained within a grid having an opening through which electrons produced by the cathode pass.

6. An electron discharge tube as in claim 5 where at least one of:

(a) an outer surface of the reservoir adjacent the exit opening, or (b) an inner surface of the grid, has applied thereto a gettering material.

7. An electron discharge tube as in claim 6 where the gettering material comprises at least one of the materials selected from the group consisting of gold, antimony and silver.

8. An electron discharge tube as in claim 1 or 2 where the work-function-reducing material consists essentially of cesium.

* * * * *